US012313062B2

(12) United States Patent
Friedrich et al.

(10) Patent No.: US 12,313,062 B2
(45) Date of Patent: May 27, 2025

(54) REFRIGERANT COMPRESSOR

(71) Applicant: BITZER Kuehlmaschinenbau GmbH, Sindelfingen (DE)

(72) Inventors: Axel Friedrich, Leipzig (DE); Andreas Becker, Halle (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 512 days.

(21) Appl. No.: 17/355,453

(22) Filed: Jun. 23, 2021

(65) Prior Publication Data

US 2021/0404463 A1 Dec. 30, 2021

(30) Foreign Application Priority Data

Jun. 24, 2020 (DE) ..... 102020116690.7

(51) Int. Cl.
*F04B 53/16* (2006.01)
*F04B 35/04* (2006.01)

(52) U.S. Cl.
CPC ..... *F04B 53/16* (2013.01); *F04B 35/04* (2013.01)

(58) Field of Classification Search
CPC ..... F04B 35/04; F04B 39/0027–0044; F04B 39/125; F04B 53/001–002; F04B 53/16; F04B 39/121; F04B 39/122
See application file for complete search history.

(56) References Cited

U.S. PATENT DOCUMENTS 5,080,130 A * 1/1992 Terwilliger ..... F04B 39/125 137/512
5,238,370 A * 8/1993 DiFlora ..... F04B 39/123 181/269
5,588,810 A * 12/1996 DiFlora ..... F04B 39/0033 181/403
5,997,258 A * 12/1999 Sawyer, III ..... F04B 39/0044 417/902
6,099,268 A * 8/2000 Pressel ..... F04B 35/06 417/234
6,164,934 A * 12/2000 Niihara ..... F04C 23/008 439/282

(Continued)

FOREIGN PATENT DOCUMENTS

CN 105508196 B * 11/2017
CN 109611311 A * 4/2019 ..... F04B 25/005

(Continued)

*Primary Examiner* — Alexander B Comley
(74) *Attorney, Agent, or Firm* — Reinhart Boerner Van Deuren P.C.

(57) ABSTRACT

A refrigerant compressor, includes an overall housing with a motor housing portion and a compressor housing portion, which has a cylinder housing with a cylinder head. The cylinder head has a cylinder head lower part arranged on the cylinder housing and a cylinder head upper part which closes off the cylinder head and has at least one outlet chamber integrated in the cylinder head upper part, in such a way that it is possible to provide optimal protection for the cylinder head. The cylinder head is covered by a hood which engages over the cylinder head upper part on an upper side facing away from the cylinder head lower part with a hood cover and over the cylinder head in the region of its peripheral side with a hood skirt surrounding the cylinder head.

36 Claims, 9 Drawing Sheets

(56) References Cited

U.S. PATENT DOCUMENTS

| | | | | |
|---|---|---|---|---|
| 6,568,921 | B2 * | 5/2003 | Dittrich | F04B 39/125 417/269 |
| 7,563,077 | B2 * | 7/2009 | Santa Ana | F04B 39/0033 417/234 |
| 10,677,477 | B2 * | 6/2020 | Gotou | F04B 39/0033 |
| 2002/0067997 | A1 * | 6/2002 | Kim | F04B 39/125 417/571 |
| 2010/0310389 | A1 * | 12/2010 | Alvarenga | F01N 1/089 417/312 |
| 2012/0063937 | A1 * | 3/2012 | Moreira | F04B 39/122 417/437 |
| 2013/0156614 | A1 * | 6/2013 | Bonifas | G10K 11/16 417/313 |
| 2015/0003971 | A1 * | 1/2015 | Miller | F16J 15/3204 415/173.1 |
| 2015/0275884 | A1 * | 10/2015 | Lilie | F04B 39/14 417/455 |
| 2018/0080666 | A1 * | 3/2018 | Gotou | G10K 11/168 |
| 2018/0291890 | A1 * | 10/2018 | Suppiger | F04B 53/001 |
| 2021/0003321 | A1 | 1/2021 | Friedrich et al. | |

FOREIGN PATENT DOCUMENTS

| | | | | |
|---|---|---|---|---|
| DE | 8602727 | U1 | 4/1986 | |
| DE | 9320524 | U1 | 8/1994 | |
| DE | 10003882 | C2 | 10/2003 | |
| EP | 1596067 | A1 * | 11/2005 | F01C 21/10 |
| EP | 2613054 | A1 * | 7/2013 | F04B 39/0033 |
| JP | 2004301074 | A * | 10/2004 | F25B 1/10 |
| WO | WO-0155594 | A1 * | 8/2001 | F04B 39/0055 |
| WO | WO-2014166788 | A1 * | 10/2014 | F04B 39/0055 |
| WO | WO-2019185121 | A1 * | 10/2019 | F04B 25/00 |

* cited by examiner

REFRIGERANT COMPRESSOR

CROSS-REFERENCE TO RELATED PATENT APPLICATION

This patent application claims the benefit of German application No. 10 2020 116 690.7 of Jun. 24, 2020, the teachings and disclosure of which are hereby incorporated in their entirety by reference thereto.

BACKGROUND OF THE INVENTION

The invention relates to a refrigerant compressor comprising an overall housing with a motor housing portion and a compressor housing portion, which has a cylinder housing with a cylinder head, the cylinder head having a cylinder head lower part arranged on the cylinder housing and a cylinder head upper part which closes off the cylinder head and has at least one outlet chamber integrated in the cylinder head upper part.

Such refrigerant compressors are known from the prior art.

With these, there is a fundamental need to protect the cylinder head against external influences.

This can be done, for example, by applying a protective layer, although a protective layer is susceptible to mechanical effects and thus does not provide lasting protection.

SUMMARY OF THE INVENTION

The object of the invention is therefore to improve a refrigerant compressor of the generic type in such a way that optimum protection of the cylinder head is possible.

In a refrigerant compressor of the type described above, this object is achieved in accordance with the invention in that the cylinder head is covered by means of a hood which engages over the cylinder head upper part on an upper side facing away from the cylinder head lower part with a hood cover and over the cylinder head in the region of its peripheral side with a hood skirt surrounding the cylinder head.

With such a hood as a separate component, there is an optimum possibility of protecting the cylinder head.

The hood can be made of a very wide variety of materials, for example plastics materials or metal, especially light metal.

In order to prevent aggressive media from entering between the hood skirt and the peripheral side of the cylinder head and thus being able to cause corrosion in the region of the cylinder head, it is preferably provided that a sealing body is arranged between the hood skirt and the peripheral side of the cylinder head.

In particular, it is favorable if the sealing body seals peripherally around the cylinder head between the hood skirt and the peripheral side of the cylinder head.

In accordance with an advantageous configuration of the sealing body, it is in the form of a bead in order to achieve an optimum seal between the peripheral side of the cylinder head and the hood.

Furthermore, an advantageous solution provides that the sealing body is made of an elastically deformable material and that the sealing body is elastically deformed between the hood skirt and the peripheral side of the cylinder head by being compressed between them.

By forming the sealing body from an elastic material and compressing it, a permanent seal between the peripheral side of the cylinder head and the hood can be achieved in a particularly simple manner.

Preferably, the sealing body is formed from a silicone material, in particular is formed from a molded body from silicone material.

No further details have yet been provided in respect of the configuration of the hood, in particular the hood skirt.

For example, an advantageous solution provides that the hood skirt widens as it extends from the hood cover toward the cylinder head lower part.

Such a solution has the advantage, particularly in conjunction with the fact that the sealing body is to be compressed between the hood skirt and the peripheral side of the cylinder head, that such a hood can be easily fitted and that the sealing body can be compressed as the hood is fitted.

A particularly favorable solution provides that the sealing body seals between an edge region of the hood skirt facing away from the hood cover and the peripheral side of the cylinder head.

This means that it is not necessary to provide a seal over the entire area between the hood skirt and the peripheral side, and instead a seal may be provided solely in the edge region.

In addition, an advantageous solution provides that the hood covers the cylinder head upper part on the upper side with the hood cover and on its entire peripheral region extending from the upper side in the direction of the cylinder head lower part with the hood skirt running from the hood cover in the direction of the cylinder head lower part and surrounding the cylinder head upper part.

This ensures that the cylinder head upper part is covered and thus protected over its entire extent by the hood.

Furthermore, it is preferably provided that the sealing body seals between the edge region of the hood skirt and a peripheral region of the cylinder head lower part, so that the sealing body and the hood skirt provide a seal already in the region of the cylinder head lower part and thus all components of the cylinder head located above the cylinder head lower part, such as the valve plate and the cylinder head upper part, are protected by the hood.

In particular, it is advantageously provided that the sealing body is part of a sealing element that abuts with a contact body on the upper side of the cylinder head upper part and extends from the contact body to the sealing body.

In this case, it is not absolutely necessary that the contact body abuts fully on the upper side, rather it is merely necessary that the contact body holds the sealing body and can thus position it in the intended location in an advantageous manner.

An advantageous solution provides that the sealing element seals between the cylinder head upper part and the hood in the region of connections, the connections being suitable for arrangement on an upper side of the cylinder head upper part or on the peripheral side of the cylinder head upper part.

In addition, a particularly advantageous solution provides that the sealing element seals with the contact body between the upper side of the cylinder head upper part and the hood cover in the region of connections, i.e., a seal is thereby provided not only between the hood skirt and the peripheral side of the cylinder head, but also in the region of the upper side of the cylinder head upper part.

In particular, it is provided that the sealing element seals in the region around a connection attachment for a connection, between the latter and the hood or between the cylinder head upper part and the hood.

In a solution with connections arranged in the region of the hood cover, for example, it is provided that the sealing element seals with the contact body in the region around a connection attachment for a connection, between the latter and the hood cover or between the upper side of the cylinder head upper part and the hood cover, in order to prevent aggressive media from penetrating in the region of the connection attachment in any case.

Furthermore, it is expediently provided that the sealing element comprises a casing body extending from the contact body to the sealing body, in which case the casing body serves to position the sealing element at the desired location in a simple manner.

A particularly favorable solution here is for the connection attachment to pass through the hood and form a sealing surface for connection for a flange with a line, so that refrigerant connections, in particular for the outlet chambers, can be provided in particular in the region of the cylinder head upper part.

It is particularly favorable here if the connection attachment has a connection extension which rises above a foot region of the connection attachment and carries the sealing surface.

In this case, it is particularly favorable if the connection extension extends through an opening in the hood cover and the hood cover of the hood surrounds the connection extension with the sealing surface on the outside, so that in particular the hood cover extends to an outer side of the connection extension.

Another advantageous solution provides that the hood cover is supported on a step surface formed by the foot region of the connection attachment and extending laterally of the connection extension.

The hood cover can be supported directly on the step surface or indirectly by means of another element.

In particular, for reasons relating to installation space, it is advantageously provided that the step surface extends around the connection extension.

A particularly advantageous embodiment example provides that the contact body of the sealing element has an annular flange that abuts on the step surface, and that an edge region of the hood cover abuts on the annular flange and is supported on the step surface by means of the latter.

This allows the edge region of the hood cover to be elastically supported in order to compensate for thickness tolerances of the hood cover, in particular to prevent it from protruding beyond the sealing surface.

In particular, this solution also makes it possible for a seal arranged between the connection flange and the sealing surface, in particular formed as a flat seal, to also seal between the connection flange and the edge region of the hood cover, since thickness tolerances of the edge region of the hood cover can be compensated for by the elastic ring flange.

Furthermore, the sealing element is preferably formed as a sealing hood which carries the sealing body on one hood edge and receives the cylinder head at least in the region of its cylinder head upper part in order to protect the cylinder head upper part as completely as possible.

It is also preferable for the hood and the sealing hood arranged thereunder to completely cover the cylinder head upper part.

Preferably, the cylinder head upper part is made of steel, as steel offers high rigidity and stability combined with low weight.

Furthermore, it is preferably provided that the hood and the sealing hood arranged thereunder receive a valve plate arranged between the cylinder head lower part and the cylinder head upper part and thus also protect this valve plate, the valve plate also being made of steel in particular.

No further details have yet been provided in respect of the general operating principle of the refrigerant compressor according to the invention.

For example, an advantageous solution provides that this compressor is a two-stage compressor and that an outlet chamber for medium pressure and an outlet chamber for high pressure are provided in the cylinder head upper part, which outlet chambers can then be integrated into the cylinder head upper part favorably from a constructional viewpoint if the cylinder head upper part is made of steel.

Within the scope of the invention, an advantageous solution provides that the overall housing is formed from a corrosion-resistant material, in particular light metal, and that the cylinder head itself is made from a material susceptible to corrosion, for example steel, it being possible to protect the cylinder head upper part against corrosion by the hood according to the invention.

Furthermore, it is preferably provided that the overall housing has a housing sleeve which has an approximately cylindrical, in particular circular-cylindrical cross-sectional shape and is closed off by a first and a second cover, the circular-cylindrical cross-sectional shape providing the possibility of optimally absorbing an internal pressure of the housing sleeve without significant deformation or also forces acting on the housing sleeve from the inside to the outside without significant deformation, despite the housing sleeve being made of light metal.

In addition, in the solution according to the invention, it is conceivable that the refrigerant compressor can also accommodate a plurality of cylinder heads for parallel or multi-stage compression.

Furthermore, it is advantageously provided that the refrigerant compressor is configured for $CO_2$ as refrigerant, so that a high pressure of usually more than 80 bar and a medium pressure of usually more than 40 bar is present in the refrigerant compressor.

The foregoing description of solutions according to the invention thus includes, in particular, the various combinations of features defined by the following consecutively numbered embodiments:

1. A refrigerant compressor (10), comprising an overall housing (12) with a motor housing portion (22) and a compressor housing portion (24), which has a cylinder housing (52) with a cylinder head (56), wherein the cylinder head (56) has a cylinder head lower part (62) arranged on the cylinder housing (52) and a cylinder head upper part (66) which closes off the cylinder head (56) and has at least one outlet chamber (82) integrated in the cylinder head upper part, wherein the cylinder head (56) is covered by means of a hood (110) which engages over the cylinder head upper part (66) on an upper side (90) facing away from the cylinder head lower part (62) with a hood cover (112) and over the cylinder head (56) in the region of its peripheral side (120) with a hood skirt (114) surrounding the cylinder head (56).

2. A refrigerant compressor according to embodiment 1, wherein a sealing body (130) is arranged between the hood skirt (114) and the peripheral side (120) of the cylinder head (56).

3. A refrigerant compressor according to embodiment 1 or 2, wherein the sealing body (130) peripherally seals around the cylinder head (56) between the hood skirt (114) and the peripheral side (120) of the cylinder head (56).

4. A refrigerant compressor according to one of the preceding embodiments, wherein the sealing body (130) is formed as a bead.

5. A refrigerant compressor according to one of the preceding embodiments, wherein the sealing body (130) is made of an elastically deformable material and the sealing body (130) is elastically deformed between the hood skirt (114) and a peripheral side (120) of the cylinder head (56) by being compressed between them.

6. A refrigerant compressor according to one of the preceding embodiments, wherein the hood skirt (114) widens with increasing extent from the hood cover (112) in the direction of the cylinder head lower part (62).

7. A refrigerant compressor according to one of embodiments 2 to 6, wherein the sealing body (130) seals between an edge region (116) of the hood skirt (114) facing away from the hood cover (112) and the peripheral side (120) of the cylinder head (56).

8. A refrigerant compressor according to one of the preceding embodiments, wherein the hood (110) covers the cylinder head upper part (66) on the upper side (90) with the hood cover (112) and on its entire peripheral region (124) running from the upper side (90) in the direction of the cylinder head lower part (62) with the hood skirt (114) running from the hood cover (112) in the direction of the cylinder head lower part (62) and surrounding the cylinder head upper part (66).

9. A refrigerant compressor according to embodiment 7 or 8, wherein the sealing body (130) seals between the edge region (116) of the hood skirt (114) and a peripheral region (122) of the cylinder head lower part (62).

10. A refrigerant compressor according to one of embodiments 2 to 9, wherein the sealing body (130) is part of a sealing element (160) which abuts on the upper side (90) of the cylinder head upper part (66) with a contact body (162) and extends from the contact body (162) to the sealing body (130).

11. A refrigerant compressor according to embodiment 10, wherein the sealing element (160) seals between the cylinder head upper part (62) and the hood (110) in the region of connections (94, 96, 106).

12. A refrigerant compressor according to embodiment 11, wherein the sealing element (160) seals with the contact body (162) between the upper side (90) of the cylinder head upper part (66) and the hood cover (112) in the region of connections (94, 96, 106).

13. A refrigerant compressor according to embodiment 11 or 12, wherein the sealing element (162) seals in the region around a connection attachment (132) for the respective connection (94, 96, 106), between the latter and the hood (110) or between the cylinder head upper part (66) and the hood (110).

14. A refrigerant compressor according to embodiment 12 or 13, wherein the sealing element (160) seals with the contact body (162) in the region around a connection attachment (132) for the respective connection (94, 96, 106), between the latter and the hood cover (112) or between the upper side (90) of the cylinder head upper part (66) and the hood cover (112).

15. A refrigerant compressor according to one of embodiments 2 to 14, wherein the sealing element (160) has a casing body (164) extending from the contact body (162) to the sealing body (130).

16. A refrigerant compressor according to one of the preceding embodiments, wherein the connection attachment (132) extends through the hood (110) and forms a sealing surface (136) for connection for a connection flange (142) with a connection line (144).

17. A refrigerant compressor according to embodiment 16, wherein the connection attachment (132) has a connection extension (146) that rises above a foot region (140) of the connection attachment (132), extends through the hood (110), and carries the sealing surface (136).

18. A refrigerant compressor according to embodiment 16 or 17, wherein the connection extension (146) extends through an opening in the hood cover (112), and the hood cover (112) of the hood (110) externally surrounds the connection extension (132) with the sealing surface (136).

19. A refrigerant compressor according to embodiment 17 or 18, wherein the hood cover (140) is supported on a step surface (148) formed by the foot region (140) of the connection attachment (132) and extending laterally of the connection extension (132).

20. A refrigerant compressor according to embodiment 19, wherein the step surface (148) runs around the connection extension (146).

21. A refrigerant compressor according to one of embodiments 17 to 20, wherein a contact body (162) of the sealing element (160) has an annular flange (168) which abuts on the step surface (148), and an edge region (154) of the hood cover (162) abuts on the annular flange (168) and is supported by means of the latter on the step surface (148).

22. A refrigerant compressor according to one of the preceding embodiments, wherein a seal (138) arranged between the connection flange (142) and the sealing surface (136) also seals between the connection flange (142) and the edge region (154) of the hood cover (112).

23. A refrigerant compressor according to one of embodiments 2 to 22, wherein the sealing element (160) is configured as a sealing hood (170) which carries the sealing body (130) at a hood edge and receives the cylinder head (56) at least in the region of its cylinder head upper part (66).

24. A refrigerant compressor according to one of the preceding embodiments, wherein the hood (110) and the sealing hood (170) arranged thereunder receive the cylinder head upper part (66) so as to completely cover it.

25. A refrigerant compressor according to one of the preceding embodiments, wherein the cylinder head upper part (66) is made of steel.

26. A refrigerant compressor according to one of the preceding embodiments, wherein the hood (110) and the sealing hood (170) arranged thereunder receive a valve plate (64) arranged between the cylinder head lower part (62) and the cylinder head upper part (66).

27. A refrigerant compressor according to one of the preceding embodiments, wherein the compressor is a two-stage compressor, and an outlet chamber (78) for medium pressure and an outlet chamber (78) for high pressure are provided in the cylinder head upper part (66).

28. A refrigerant compressor according to one of the preceding embodiments, wherein the refrigerant compressor is configured for $CO_2$ as refrigerant.

29. A refrigerant compressor according to the preamble of embodiment 1 or according to one of the preceding embodiments, wherein an electric motor (102) is arranged in the motor housing portion (22), the stator (172) of which motor is mounted in the motor housing portion (22) by means of supporting elements (192, 194) which, on the one hand, are supported on a stator-receiving surface (184) of the motor housing portion (122) and, on the other hand, support the stator (172) on its outer side (182).

30. A refrigerant compressor according to embodiment 29, wherein the supporting elements (192, 194) comprise elastic bodies (202) which are dimensioned such that they undergo only elastic deformation in all operating states occurring during operation of the refrigerant compressor.

31. A refrigerant compressor according to the preamble of embodiment 1 or according to one of the preceding embodiments, wherein the overall housing has a first cover (14) and a second cover (18), between which a housing sleeve (16) extends, which has a motor housing portion (22) and a compressor housing portion (24), in which a cylinder housing (52) is provided, and wherein a connection (96) for supplying refrigerant into the motor housing portion (22) and also at least one contact insert (252, 262) for guiding electrical supply lines into the overall housing (12) are provided in one of the covers (14, 18).

32. A refrigerant compressor according to one of the preceding embodiments, wherein refrigerant connections (92, 94, 96, 106) guided into the overall housing (12) are arranged either in the cylinder head upper part (66) or in one of the covers (14, 18).

33. A refrigerant compressor according to one of the preceding embodiments, wherein the overall housing (12) is formed from a corrosion-resistant material, and the cylinder head upper part is formed from a corrosion-susceptible material.

34. A refrigerant compressor according to one of the preceding embodiments, wherein the overall housing (10) has a substantially cylindrical, in particular circular-cylindrical, cross-sectional shape.

Further features and advantages of the invention are the subject of the following description as well as the graphical representation of some embodiment examples.

DETAILED DESCRIPTION OF THE INVENTION

Figure 1:
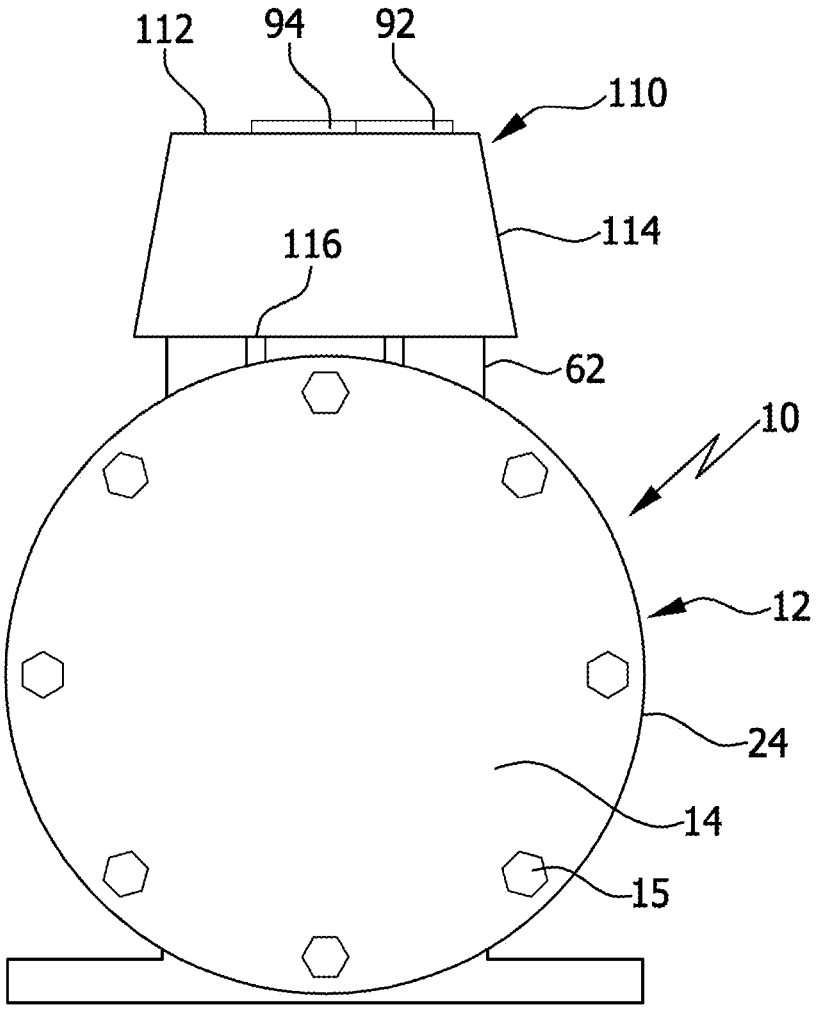
FIG. 1 shows a front view of a first embodiment example of a refrigerant compressor according to the invention.
Figure 2:
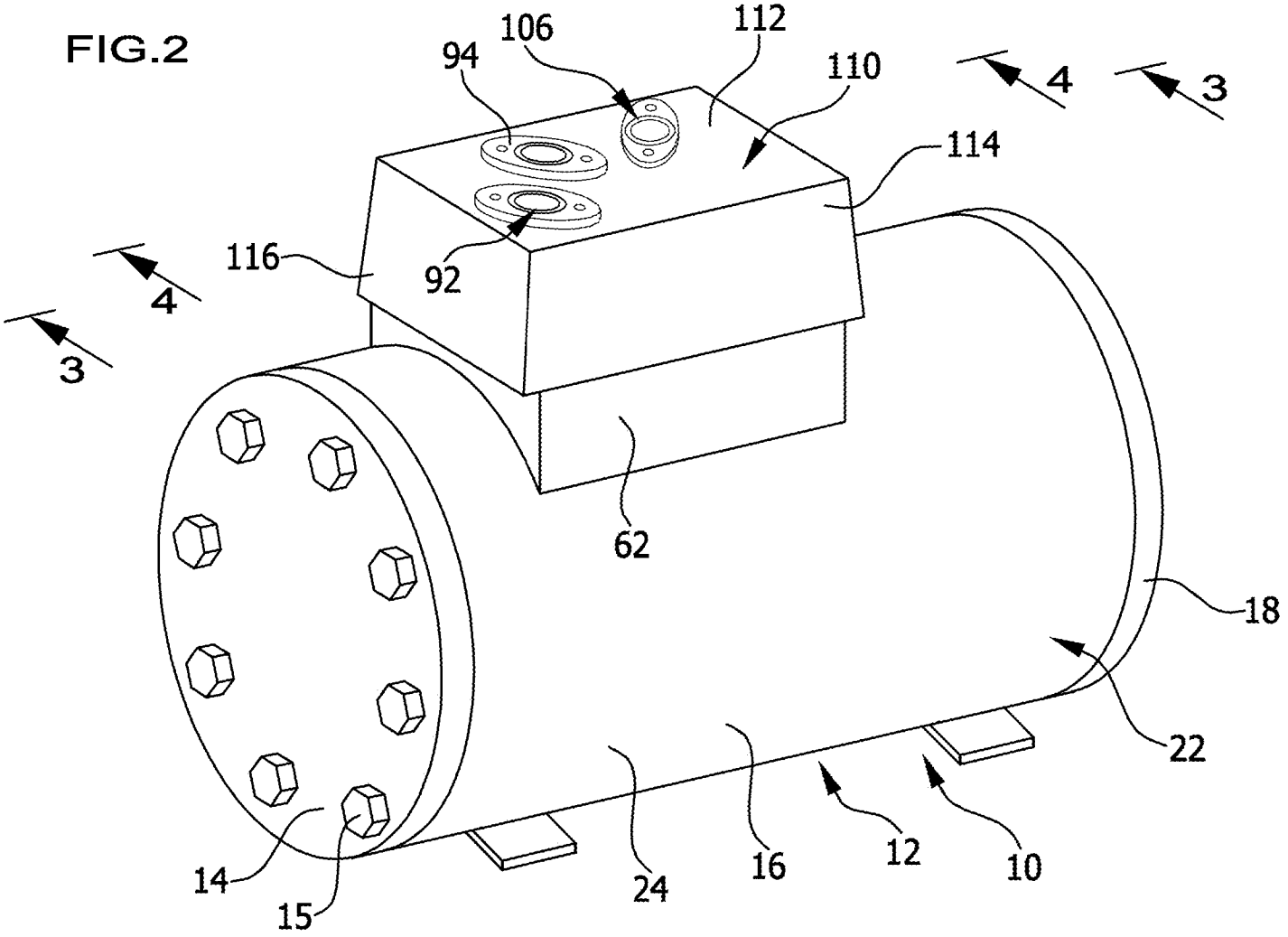
FIG. 2 shows a perspective overall view of a first embodiment example of the refrigerant compressor according to the invention.

A first embodiment example of a refrigerant compressor 10 according to the invention shown in FIGS. 1 and 2 comprises an overall housing 12, which has a first housing cover 14 at an end face, from which an approximately cylindrical, in particular circular-cylindrical, housing sleeve 16 extends to a second cover 18, the first cover 14 and the second cover 18 closing the housing sleeve 16 at one end face each and being connected to the housing sleeve 16 by screw connections 15, 19.

The housing sleeve 16 thus has an extremely advantageous cross-sectional shape in order to be able to absorb the compressive forces occurring as uniformly as possible.

This overall housing 12 further comprises a motor housing portion 22, in which a drive motor to be described in more detail below is arranged, and a compressor housing portion 24, which at one side comprises a drive gear housing 32, in which a drive shaft 34 is rotatably mounted about a drive shaft axis 36, the drive shaft 34 carrying eccentric bodies 42 which act on connecting rods 44 which in turn drive pistons 46.

In a cylinder housing 52 also comprised by the compressor housing portion 24, the pistons 46 are guided movably in a reciprocating manner in individual cylinders 54*a*, 54*b*, and 54*c* of the cylinder housing 52 to compress refrigerant.

The cylinder housing 52 carries a cylinder head 56, which is formed by a cylinder head lower part 62 which is integrally molded on the cylinder housing 52 and which, in turn, also receives the cylinders 54, the cylinder head lower part 62 carrying a valve plate 64 which closes off the cylinders 54 and on which, in turn, a cylinder head upper part 66 is arranged on a side opposite the cylinder head lower part 62.

Figure 3:
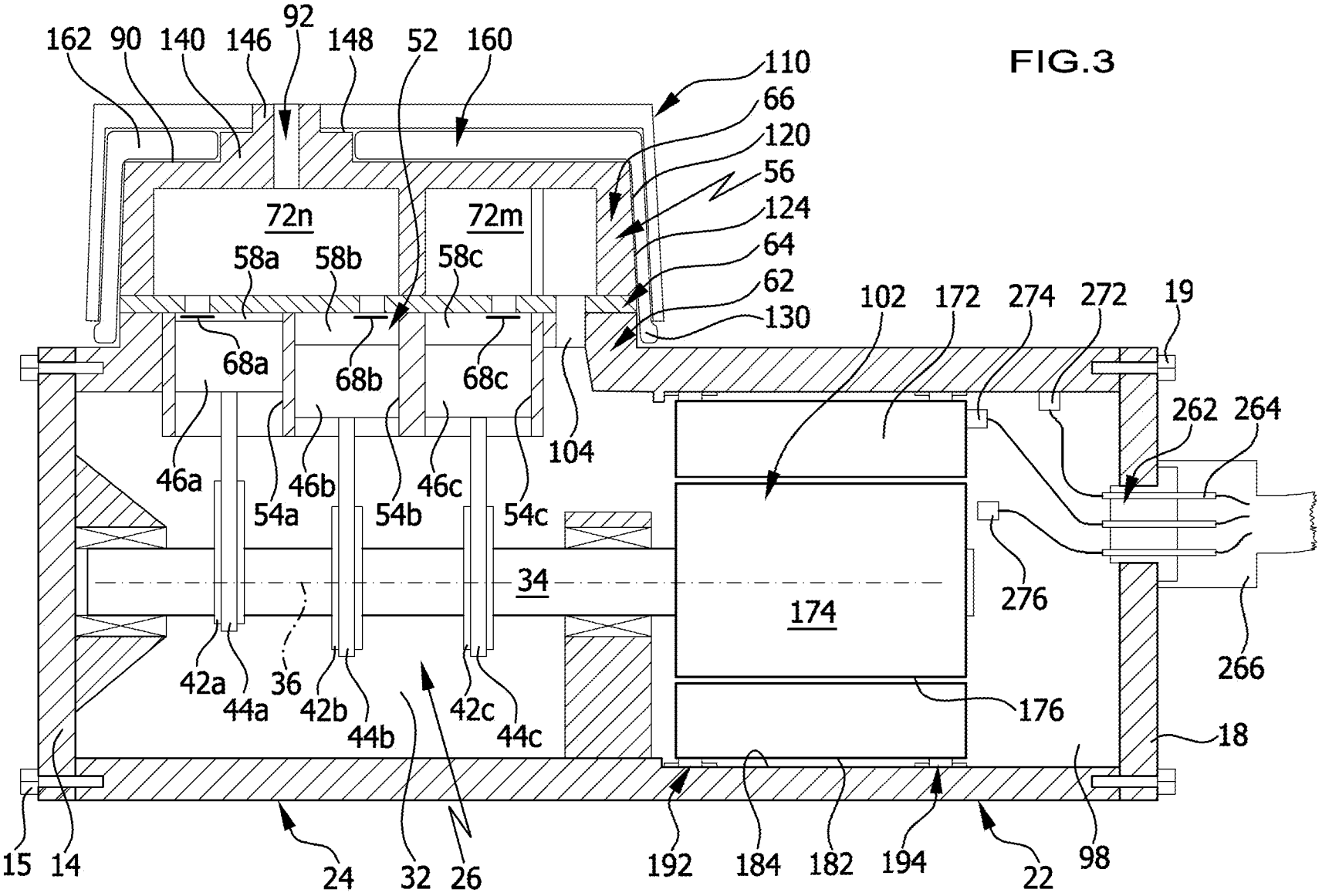
FIG. 3 shows a section along line 3-3 in FIG. 2.

The valve plate 64 not only closes off individual compression chambers 58*a*, 58*b*, 58*c* of the cylinders 54*a*, 54*b*, 54*c* on their sides opposite the pistons 46, but also carries inlet and outlet valves, with only examples of the inlet valves 68 being shown in FIG. 3.

Figure 4:
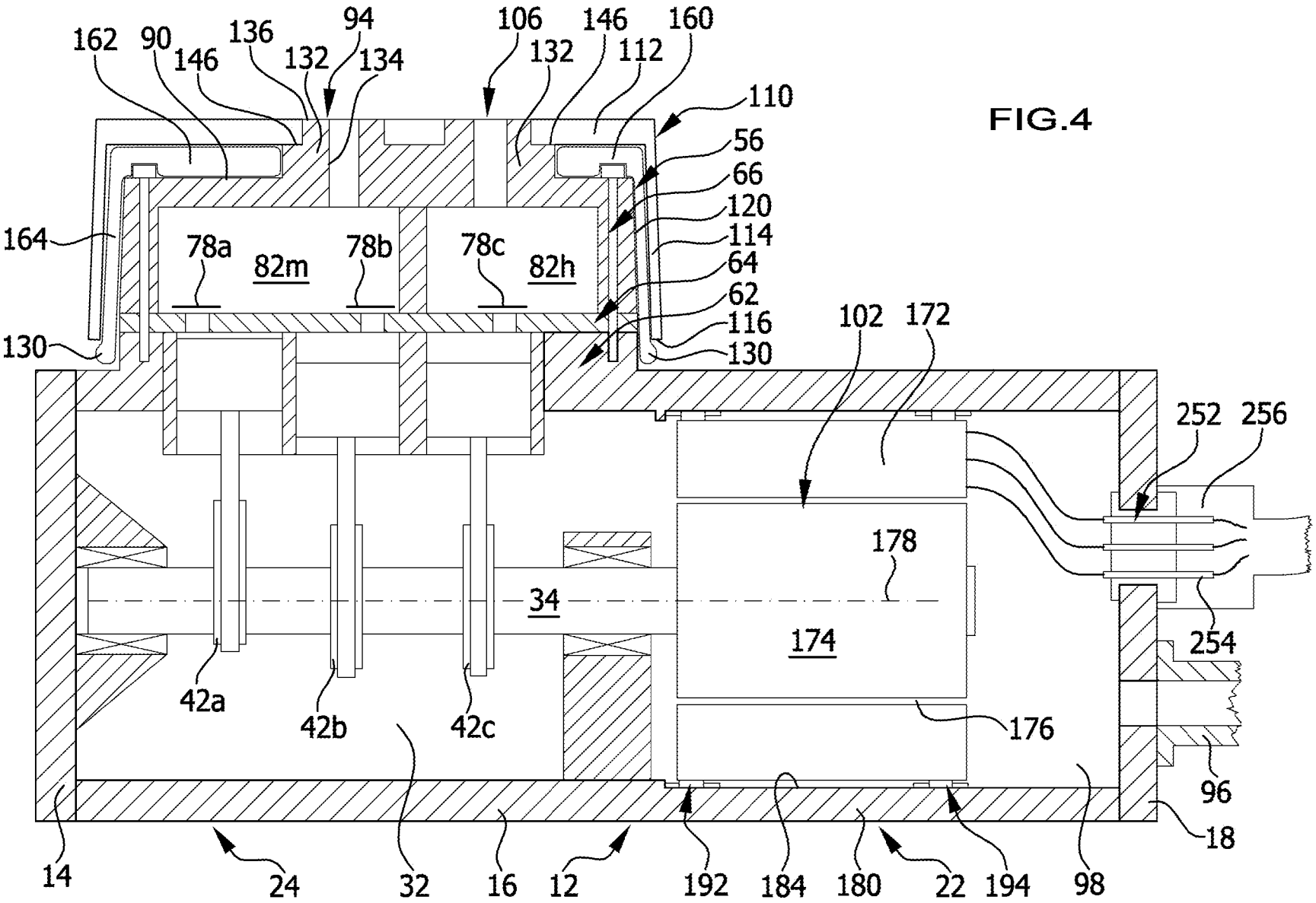
FIG. 4 shows a section along line 4-4 in FIG. 2.

According to FIG. 3, inlet chambers 72 associated with the inlet valves 68 are provided in the cylinder head upper part 66, while FIG. 4 shows outlet valves 78 in the valve plate 64, which are associated with outlet chambers 82 in the cylinder head upper part 66.

For example, the refrigerant compressor 10 is configured as a two-stage compressor in which refrigerant at intake pressure is supplied, by means of an intake connection 92 arranged on an upper side 90 of the cylinder head upper part 66 (FIG. 3), to the inlet chamber 72*n*, from which the refrigerant then enters the compression chambers 58*a* and 58*b* by means of the inlet valves 68*a* and 68*b*, is compressed there by the pistons 46*a* and 46*b* and enters the outlet chamber 82*m* (FIG. 4) by means of the outlet valves 78*a* and 78*b*, in which outlet chamber the refrigerant is then compressed to medium pressure.

By means of a pressure connection 94 likewise arranged on the upper side 90 of the cylinder head upper part 66, for example, the refrigerant can be discharged, cooled and supplied to a medium-pressure connection 96 in the overall housing 12, the medium-pressure connection 96 preferably being provided in the second housing cover 18 and thus allowing the cooled refrigerant to enter a motor chamber 98 in the motor housing portion 22, in which an electric motor denoted as a whole by 102 is cooled and, after cooling of the electric motor 102, the refrigerant, as shown in FIG. 3, can in turn enter the inlet chamber 72*m* by means of a housing passage 104, from which inlet chamber the refrigerant present at medium pressure enters the compression chamber 58*c* by means of the inlet valve 68*c*, is compressed therein, and enters the outlet chamber 82*h* in the cylinder head upper part 62 by means of the outlet valve 78*c*, in which cylinder head upper part the refrigerant is then at high pressure (FIG. 4).

From this outlet chamber 82*h*, the refrigerant can then in turn be supplied to a refrigerant circuit by means of a pressure connection 106 arranged on the upper side 90 of the cylinder head upper part 66.

In this solution, refrigerant compressed to medium pressure is thus present in the overall housing 12, in particular in the drive chamber 32 and also in the motor chamber 98, so that, for example, when the refrigerant compressor 10 is used in a refrigerant circuit with $CO_2$ as refrigerant, high pressures of 40 bar and more are already present in the overall housing 10.

In order to be able to produce the overall housing 10 with the lowest possible weight, the housing sleeve 16 with the housing covers 14 and 18 is made of light metal, in particular aluminum, and, in the same way, so too is the cylinder head lower part 62 molded thereon. The use of light metal, in particular aluminum, also offers the advantage that the housing sleeve 16 and the housing covers 14, 18 are corrosion-resistant.

Preferably, the valve plate 64 is made of steel and the cylinder head upper part 66 is also formed in the same way, since in the outlet chambers 82*m* and 82*h* of the cylinder head upper part there is medium pressure on the one hand and high pressure on the other, which can reach more than 80 bar, especially with $CO_2$ as the refrigerant, so that these components would not withstand the mechanical oscillating loads if they were made of light metal.

To protect the cylinder head 56, in particular the cylinder head upper part 66, a hood denoted as a whole by 110 is provided, which on the one hand has a hood cover 112 engaging over an upper side 90 of the cylinder head upper part 66, from which hood cover a hood skirt 114 extends in the direction of the housing sleeve 16 and ends in an edge region 116.

The purpose of the hood 110 is to protect the cylinder head 56, in particular the cylinder head upper part 62 and, if necessary, also the valve plate 64, against the effects of weather and aggressive media.

To achieve this, a seal is provided between the hood skirt 114 and a peripheral side 120 of the cylinder head 56 by means of a sealing body 130 made of an elastic material, for example silicone, shown in FIGS. 3 and 4, preferably in the form of a bead, which is preferably compressed between the edge region 116 and the peripheral side 120 of the cylinder head 56, the sealing body 130 preferably being acted upon on the one hand by the edge region 116 and on the other hand by a peripheral region 122 of the peripheral side 120 of the cylinder head 56, which surrounds the cylinder head lower part 62.

Thus, no moisture or other medium is able to penetrate into a space between the hood skirt 114 having the edge region 116 of the hood 110 and the peripheral side 120 of the cylinder head 56 and is prevented from causing damage to the material of the valve plate 64 or the cylinder head upper part 66 at its peripheral region 124 of the peripheral side 120.

Figure 5:
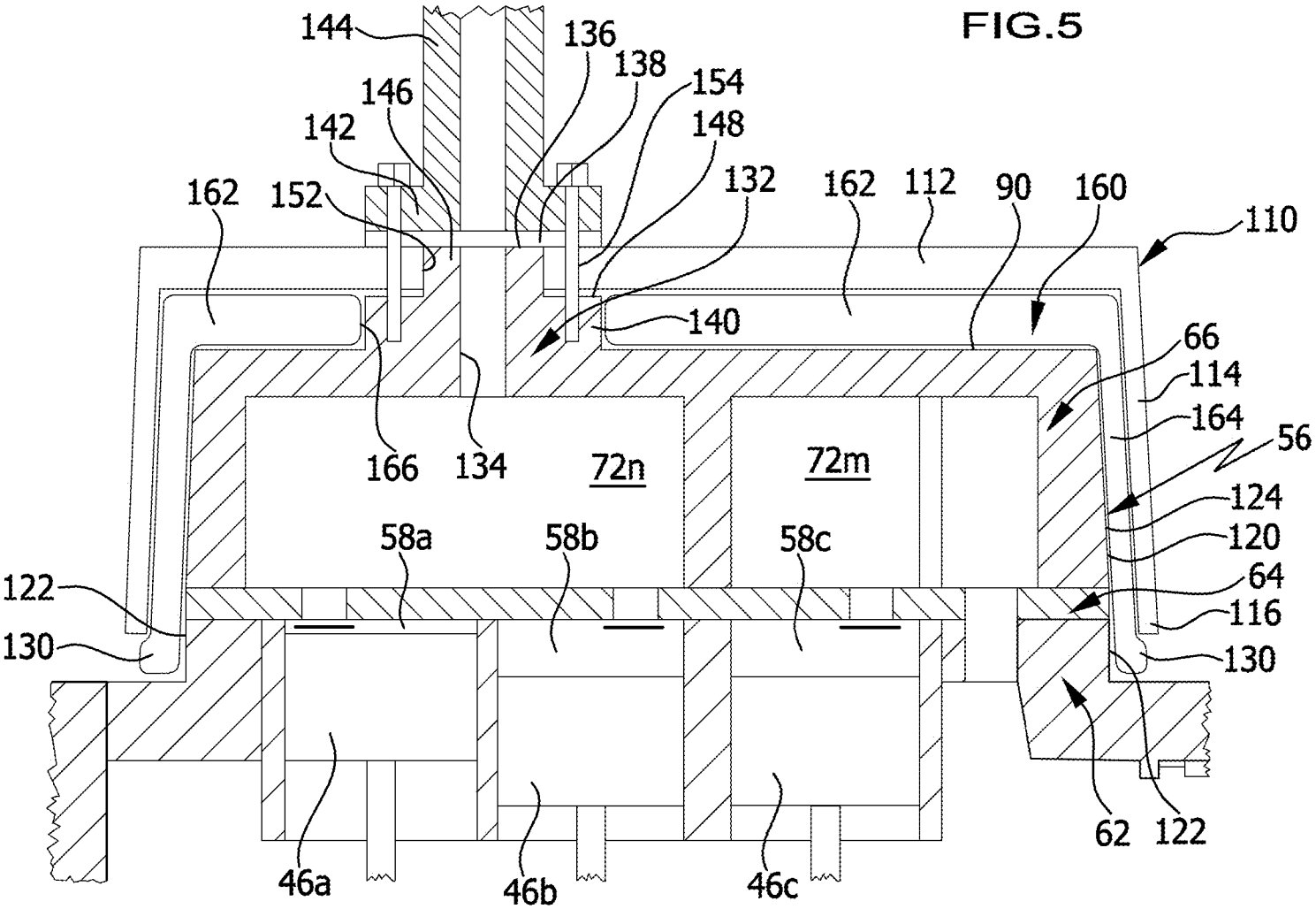
FIG. 5 shows an enlarged sectional view in the region of a cylinder head upper part.

In order to also prevent moisture or any other medium from penetrating under the hood 110 in the region of the hood cover 112, the intake connection 92, the pressure connection 94 and the pressure connection 106 are preferably each formed by connection attachments 132 arranged in the cylinder head upper part 66 and projecting beyond the latter on the upper side 90 opposite the valve plate 64, which connection attachments in each case surround a passage 134 leading to the corresponding inlet chamber 72 or outlet chamber 82 and, on a side facing away from the upper side 90, form a sealing surface 136 on which a seal 138, in particular a flat seal, can be placed which, for its part, can be pressed against the sealing surface 136 by a connection flange 142 connected to a connection line 144 when the connection flange is screwed to the respective connection attachment 132 of the cylinder head upper part 66 (FIG. 5).

Preferably, the connection attachment 132 is formed in each case in such a way that it has a foot region 140, from which a connection extension 146 surrounding the passage 134 extends to the sealing surface 136 and forms a step 148 at a spacing from the sealing surface 136, which step is formed peripherally around the connection extension 146 and the passage 134 and forms a support for the hood cover 112, which is provided in the region of the connection attachment 132 with an edge region 154 which engages around the connection extension 146 and has an aperture 152, so that the hood cover 112 can be held at a spacing from the cylinder head upper part 66, in particular the upper side 90 thereof, in particular by the respective steps 148 formed at the intake connection 92, the pressure connection 94 and the pressure connection 106 (FIG. 5).

Preferably, a sealing element denoted as a whole by 160 is arranged between the hood 110 and the cylinder head upper part 66 and preferably abuts on the upper side 90 of the cylinder head upper part 66 with a contact body 162 which is provided with recesses 166 so that the connection attachments 132 can penetrate it and the contact body 162 thus surrounds the connection attachments 132.

Further, a casing body 164 of the sealing element 160 extends from the contact body 162 to the sealing body 130, which is integrally molded on the casing body 164.

The casing body 164 is located between the peripheral side 120 of the cylinder head 56 and the hood skirt 114, and although a seal between the peripheral side 120 and the hood skirt 114 may be provided in the region of the casing body 164, this is not absolutely necessary, since the primary seal is provided by the sealing body 130, which provides its sealing effect between the edge region 116 of the hood 110 and the peripheral region 122 of the cylinder head lower part 62.

However, it is still possible prophylactically to obtain an additional sealing effect by a suitable construction of the casing body 164, for example by means of beads or ribs formed therein.

Also, in principle, the contact body 162 is not configured to provide a seal across the full area between the hood cover 112 of the hood 110 and the upper side 90 of the cylinder head upper part 66, but advantageously the contact body 162 is configured to provide an additional seal between the hood cover 112 and the upper side 90 in regions around the connection attachments 132 of the cylinder head upper part 66.

Primarily, however, the contact body 162 as well as the casing body 164 serve to precisely and reliably and permanently position the sealing body 130 so that it can permanently and reliably provide its sealing effect between the edge region 116 and the cylinder head lower part 62 in the peripheral region 122, which represents a part of the peripheral side 120 of the cylinder head 56.

Preferably, the sealing element 160 is formed with the contact body 162, the casing body 164 and the sealing body 130 as a one-piece pre-formed part made of a silicone material, which can be placed as a whole over the cylinder head 56, in particular the cylinder head upper part 66 thereof, before the hood 110 is fitted.

Figure 6:
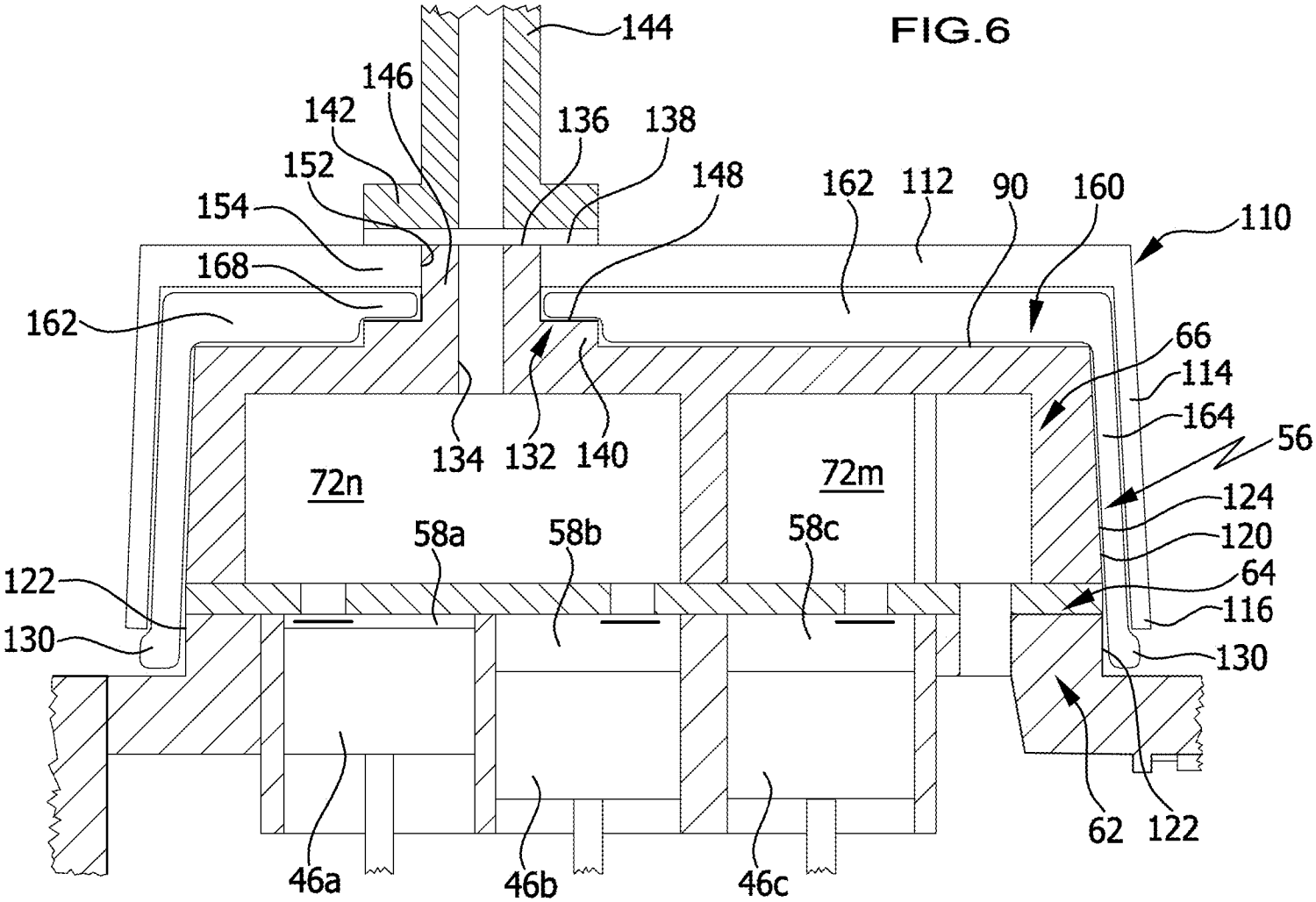
FIG. 6 shows a sectional view similar to FIG. 5 through a second embodiment example of a refrigerant compressor according to the invention.

In a second embodiment example of the solution according to the invention shown in FIG. 6, the contact body 162 is provided in the region of the recesses 166 with an annular flange 168 reaching as far as the connection extension 146, which flange abuts on the step 148 and on which, in turn, the hood cover 112 abuts with its edge region 154 supporting the aperture 152, so that the edge region 154 is flexibly supported on the step surface 148 due to the forming of the annular flange 168 from the elastic material of the sealing element 160, and thus compensation for thickness tolerances in the edge region 154 is possible, so that the seal 138, which is acted upon by the connection flange 142 acted upon by screw fittings, can also still provide a tight connection in the edge region 154 of the hood cover 112 and additionally fixes the hood 110 as a whole.

As a further alternative to the first and second embodiment examples, solutions are also conceivable in which connection extensions are not arranged on the upper side 90 of the cylinder head upper part 66, but on the peripheral side 120 thereof.

In this case, too, it is possible to achieve a seal by means of the sealing element 160 in the region of the connection attachments 132, in a manner similar to that in the region of the upper side of the cylinder head upper part 66.

For example, in this case the hood 110 could be made in two parts.

In a further embodiment example, the cylinder head upper part 66 is not provided with any connection attachment and can likewise be covered by the hood 110 in the same way as described for the previous solutions.

Moreover, in the second embodiment example, those elements which are identical to the first embodiment example are provided with the same reference sign, so that reference can be made in this respect to the explanations provided in relation the first embodiment example.

As shown in FIGS. 3 and 4, in both embodiment examples, the motor chamber 98 of the overall housing 12 houses the electric motor 102, which has a stator 172 that is non-rotatably mounted in the motor housing portion 22 and a rotor 174 that is surrounded by the stator 172 and rotatable about a rotor axis 178 that coincides with the drive shaft axis 36 in the present embodiment examples.

A gap 176 is formed between the rotor 174 and the stator 172.

Figure 7:
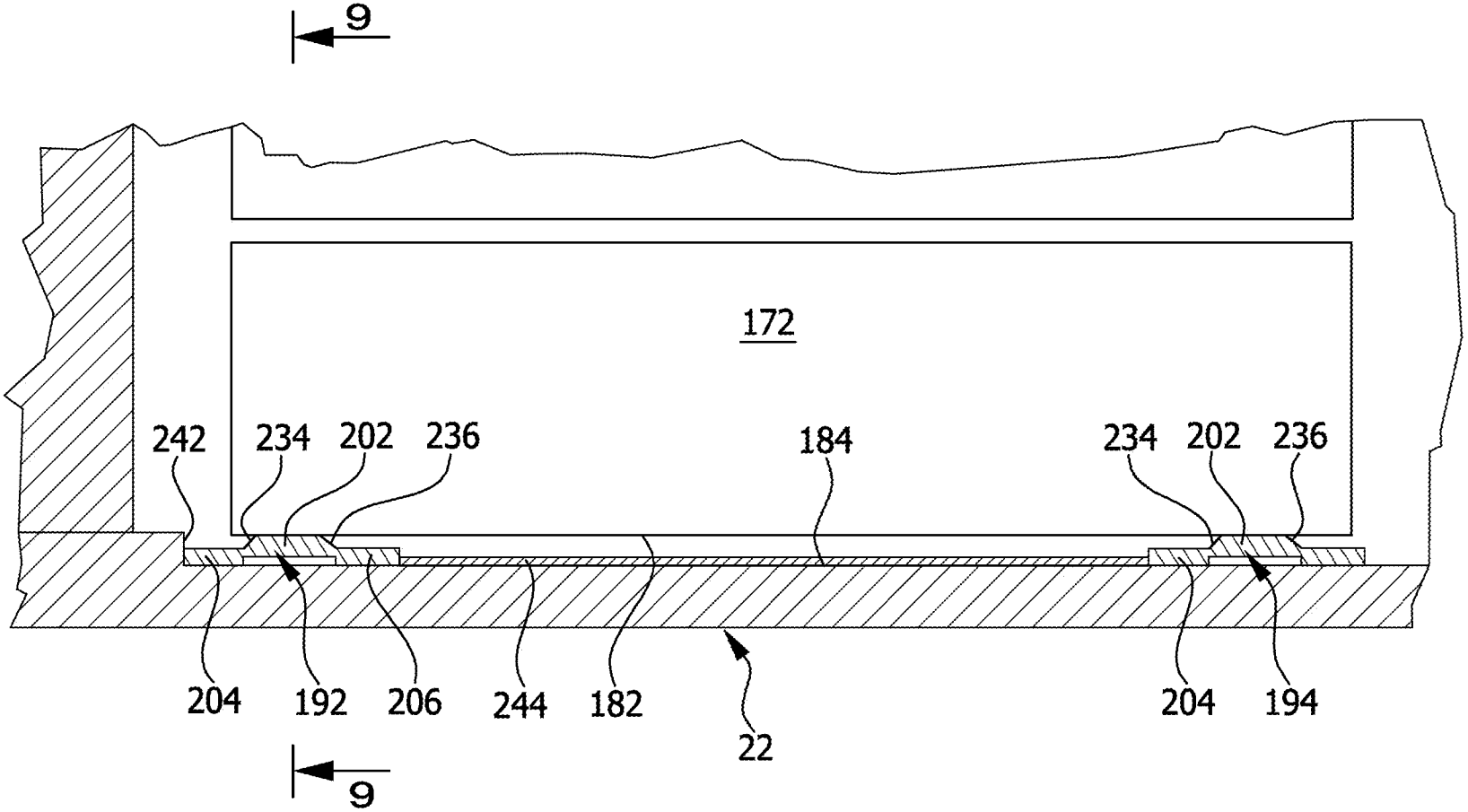
FIG. 7 shows a longitudinal section through the overall housing according to FIG. 2 in the region of a motor housing portion.

The stator 172 is preferably mounted in the motor housing portion 22, as shown in FIGS. 3, 4 and 7, by supporting elements 192 and 194 acting between an outer surface 182 of the stator 172 and a stator-receiving surface 184 of the motor housing portion 22, which supporting elements are spring-elastically deformable in a radial direction in relation to the rotor axis 178 and support the stator 172 relative to the stator-receiving surface 184.

Figure 8:
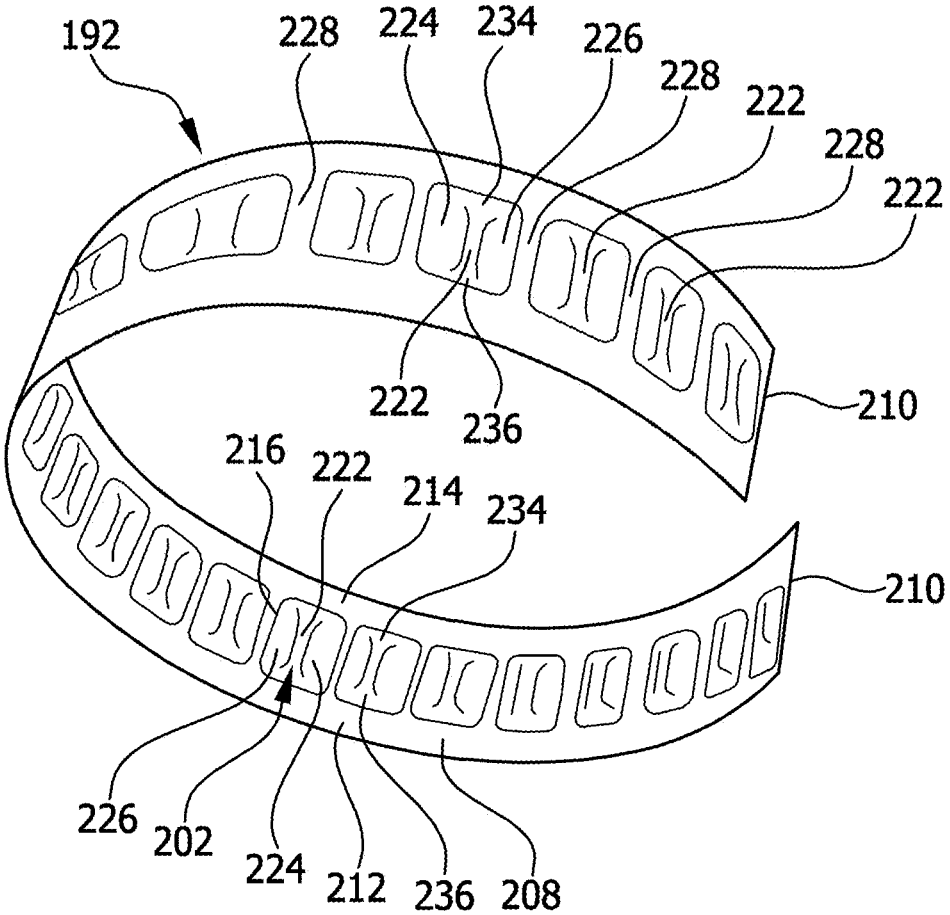
FIG. 8 shows a perspective view of a contact body for mounting a stator in the motor housing portion.
Figure 9:
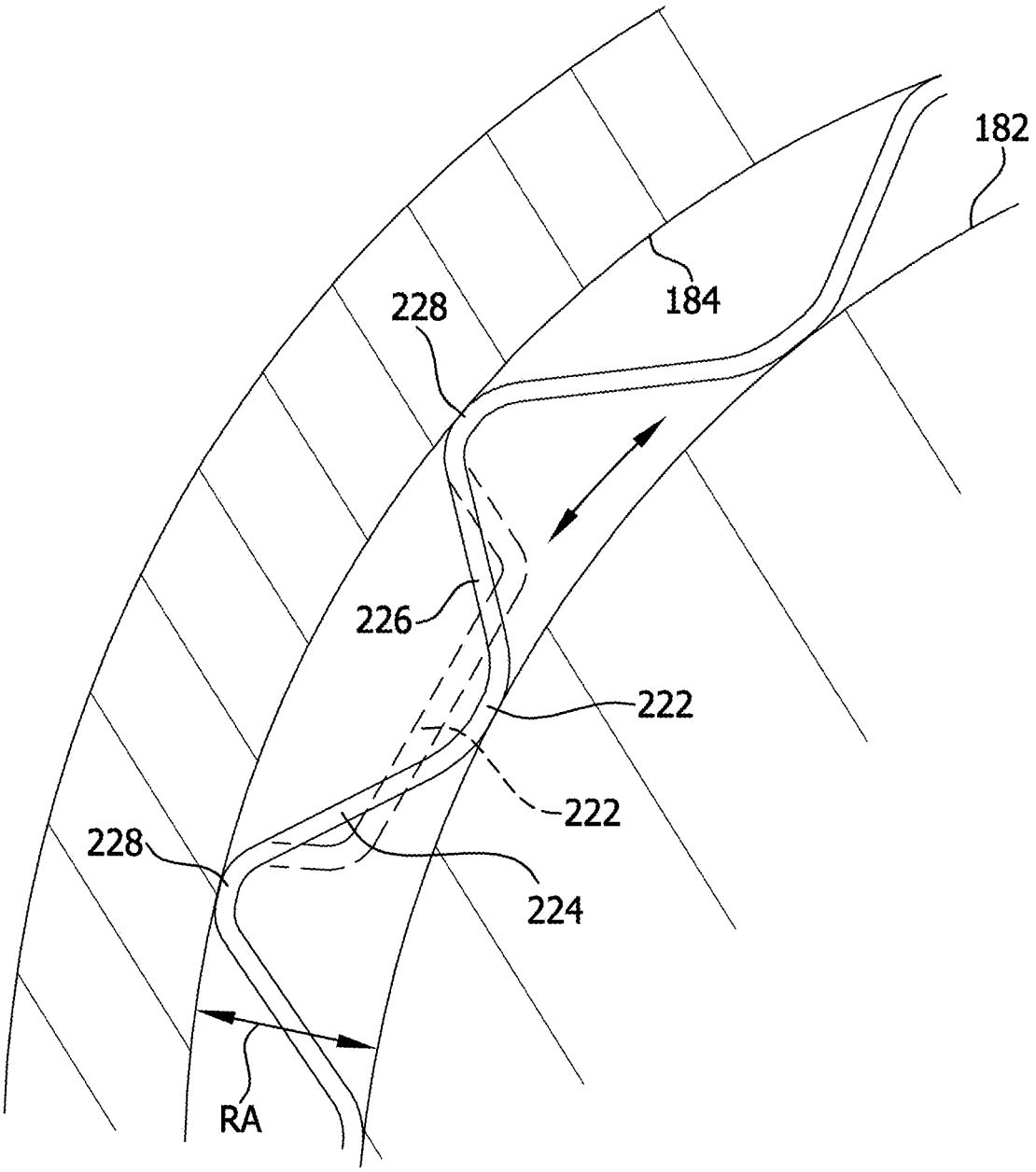
FIG. 9 shows part of a sectional view along line 9-9 in FIG. 7.

Preferably, each of the supporting elements 192, 194, as shown for example in FIGS. 8 and 9, comprises spring-elastically deformable bodies 202 in a radial direction in relation to the rotor axis 178, which bodies for example support the stator 172 at the outer side 182, and retaining elements 204 and 206 arranged on both sides of the spring-elastically deformable bodies 202, as considered in the direction of the rotor axis 178, and connecting the elastic bodies 202 to each other, which retaining elements are supported at the stator-receiving surface 184 of the motor housing portion 22.

However, it is also possible for the retaining elements 204 and 206 to be supported at the outer side 182 of the stator 172 and for the elastically deformable bodies 202 to be supported at the stator-receiving surface 184 of the motor housing portion 22.

As shown by way of example in FIGS. 8 and 9 in conjunction with the supporting element 192, these supporting elements 192, 194 can be produced by a band material 208 in the form of an annular clasp with ends 210 which are spaced apart from one another, the edge regions 212 and 214 of which band material form the retaining elements 204 and 206 and in the central region 216 of which band material the elastically deformable bodies 202 are formed by structures impressed in the band material 208, which structures rise between the edge regions 212 and 214 and form support regions 222, which abut against the outer side 182 of the stator 172 and in the peripheral direction around the rotor axis 178 are connected by means of rising flank regions 224 and 226, which run at an acute angle to the surface supporting them, in FIG. 9 at an acute angle to the stator-receiving surface 184, to foot regions 228 which abut against the stator-receiving surface 184, and in addition are connected to the edge regions 212 and 214, which likewise abut against the stator-receiving surface 184, in a direction parallel to the rotor axis 178 by means of flank regions 234 and 236 running at an acute angle to the supporting stator-receiving surface 184.

By forming the supporting elements 192, 194 from a band material 208 with ends 210 spaced apart from one another, they can be inserted into the stator-receiving surface 184 without any material removal.

In particular, the flank regions 234 and 236 form insertion chamfers that allow for assembly or disassembly of the stator 172 without any material removal.

In particular, the supporting elements 192, 194 allow the "hard" stator 172 to be mounted in the "soft" motor housing portion 22 if this is made of light metal, in particular aluminum, without causing any damage to the motor housing portion 22; the same applies when replacing the electric motor 102.

Furthermore, the configuration of the housing sleeve 16 with a cross-sectional shape that is as circular-cylindrical as possible is also advantageous in this case, since the forces required to receive the electric motor 102 and the compressive forces can also be optimally absorbed in the motor housing portion 22 in this case, in particular without any appreciable widening of the motor housing portion 22, so that, in turn, precise mounting of the electric motor 102 by the supporting elements 192 and 194 is possible.

Due to the flank regions 224 and 226 and also 234 and 236 running with a gentle gradient to the surface supporting them, in FIG. 9 to the stator-receiving surface 184, the spring-elastic deformation of the deformable bodies 202 occurs primarily in the flank regions 224, 226 and 234 and 236, as shown in FIG. 9 at the flank regions 224 and 226 in a dashed manner.

Preferably, the spring-elastic bodies 202 are configured in such a way that they follow all variations of the radial spacing RA (FIG. 9) between the outer side 182 of the stator 172 and the stator-receiving surface 184 by elastic deformation, without plastic deformations occurring in the region of the elastic bodies 202, in particular the flank regions 224, 226 as well as 234 and 236.

This makes it possible to keep the stator 172 always coaxial with the rotor axis 178, irrespective of the thermal and/or pressure-induced radial expansion of the motor housing portion 22 and the thermally induced radial expansion of the stator 172.

Such pressure-induced radial expansions of the motor housing portion 22 occur in particular because the motor chamber 98 is at medium pressure and the housing sleeve 16 of the overall housing 12 is made of light metal.

In addition to the pressure load on the motor housing portion 22, there is also thermal expansion depending on the operating state of the stator 172 and the motor housing portion 22.

Since all such deformations, which have the effect of changing the radial spacing RA, are absorbed by the spring-elastic bodies 202 in the form of purely elastic deformations, an optimally small gap 176 between the rotor 174 and the stator 172 can be maintained regardless of the operating state of the refrigerant compressor.

Since all of the elastic elements 202 are arranged, for example, in a band material 208 and are held in their positions relative to each other by the retaining elements 204 and 206, the retaining elements 204 and 206 can be arranged running in a practically closed manner around the stator 172 in planes running perpendicular to the rotor axis 178, thereby holding the elastic elements 202 in defined positions relative to the outer side 182 of the stator 172 and to the stator-receiving surface 184.

For exact positioning of the supporting elements 192 and 194 in the motor housing portion 122, a step 242 is preferably provided adjacently to the rotor receiving surface 184, specifically on a side facing the drive chamber 22, which step 242 runs around the rotor axis 178 and serves to position one of the supporting elements 192 facing the drive chamber 32.

In order to be able to position the second supporting element 194 precisely relative to the first supporting element 192, it would in principle be conceivable to also provide a step in the motor housing portion 22, but this would mean a further weakening of a wall thickness of the motor housing portion 22.

For this reason, a spacer element 244 is provided between the supporting elements 192 and 194 as shown in FIG. 7, which spacer element, for example, abuts against the retaining elements 206 and 204 of the supporting elements 192 and 194 respectively and thus predetermines the exact position of the second supporting element 194 relative to the first supporting element 192.

For example, the spacer element 244 is configured to abut against the stator-receiving surface 184 of the motor housing portion 22 and to run partially or completely around the rotor axis 178 to keep the supporting elements 192 and 194 in relatively precise positions throughout their extent around the rotor axis 178.

For example, the supporting elements 192, 194 and/or the spacer element 244 are formed by annular sheet-metal elements, in particular made from band material 208, having ends 210 spaced apart from one another which tend to widen in the radial direction so that these sheet-metal elements automatically abut against the stator-receiving surface 184 and are fixed by frictional engagement.

This allows the supporting elements 192, 194 and, as applicable, the spacer element 244 to be inserted into the stator-receiving surface 184 without material removal.

For the electrical supply of the electric motor 102, a contact insert 252 is preferably provided in the second cover 18, which contact insert receives electrical contact elements 254 that are guided through the second cover 18 (FIG. 4).

On a side facing away from the motor chamber 98, a contact plug 256 can be plugged onto the contact insert 252, by means of which contact is made with all the contact elements 254 received in the contact insert 252.

Furthermore, a second contact insert 262 is provided in the second cover 18 (FIG. 3) and has additional electrical contact elements 264. Preferably, these additional contacts 264 serve to establish electrical connections to sensors arranged in the overall housing 12, for example pressure sensors 272, and/or temperature sensors 274 and/or rotary speed sensors 276, which serve to monitor the compressor function and the motor function, so that an electrical supply line to all sensors serving for the compressor function and/or the motor function and arranged in the overall housing 12 is preferably provided by means of the contact insert 262 and a contact plug 266.

However, it is also possible to provide all electrical contact elements 254 and 264 in a contact insert of correspondingly complex configuration.

In addition, the second cover 18 (FIG. 4) also includes the medium-pressure connection 96, by means of which refrigerant under medium pressure can be supplied directly to the motor chamber 98, specifically on a side opposite the drive chamber 32, and flows through the electric motor 102, cools it, before then entering the inlet chamber 72*m*.

The invention claimed is:

1. A refrigerant compressor, comprising an overall housing with a motor housing portion and a compressor housing portion, the compressor housing portion having a cylinder housing with a cylinder head, the cylinder head having a cylinder head lower part arranged on the cylinder housing, the cylinder head projecting above the cylinder housing to define an upper side face spaced from the cylinder housing and a peripheral side extending between the upper side face and the cylinder housing, a cylinder head upper part which closes off the cylinder head, and at least one outlet chamber integrated in the cylinder head upper part, wherein the cylinder head is covered by means of a hood which includes a hood cover and a hood skirt projecting from the hood cover, wherein the hood cover engages over the cylinder head upper part on the upper side face facing away from the cylinder head lower part and the hood skirt extends below the upper side face of the cylinder head and over and around the peripheral side of the cylinder head to surround the cylinder head, and wherein a valve plate is arranged between the cylinder head lower part and the cylinder head upper part, with the valve plate extending into the hood and being surrounded by the hood skirt, and wherein the cylinder head includes a pressure connection arranged to face an external environment.

2. A refrigerant compressor according to claim 1, wherein a sealing body is arranged for providing a seal between the hood skirt and the peripheral side of the cylinder head and in contact with the cylinder head.

3. A refrigerant compressor according to claim 2, wherein the sealing body peripherally seals around the cylinder head between the hood skirt and the peripheral side of the cylinder head.

4. A refrigerant compressor according to claim 2, wherein the sealing body is formed as a bead.

5. A refrigerant compressor according to claim 2, wherein the sealing body is made of an elastically deformable material, and the sealing body is elastically deformed between the hood skirt and the peripheral side of the cylinder head by being compressed between them.

6. A refrigerant compressor according to claim 2, wherein the sealing body seals between an edge region of the hood skirt facing away from the hood cover and the peripheral side of the cylinder head.

7. A refrigerant compressor according to claim 6, wherein the sealing body seals between the edge region of the hood skirt and a peripheral region of the cylinder head lower part.

8. A refrigerant compressor according to claim 2, wherein the sealing body is part of a sealing element which abuts on the upper side face of the cylinder head upper part with a contact body and extends from the contact body to the sealing body.

9. A refrigerant compressor according to claim 8, wherein the sealing element seals between the cylinder head upper part and the hood in a region of a plurality of pressure port connections provided by the cylinder head, the pressure port connections including said pressure connection.

10. A refrigerant compressor according to claim 9, wherein the sealing element seals via the contact body between the upper side face of the cylinder head upper part and the hood cover in the region of the pressure port connections.

11. A refrigerant compressor according to claim 10, wherein the sealing element seals via the contact body in the region around a connection attachment for a respective member of the pressure port connections, between the respective member and the hood cover or between the upper side of the cylinder head upper part and the hood cover.

12. A refrigerant compressor according to claim 9, wherein the sealing element seals in a region around a connection attachment for a respective member of the pressure port connections, between the respective member and the hood or between the cylinder head upper part and the hood.

13. A refrigerant compressor according to claim 8, wherein the sealing element is configured as a sealing hood which carries the sealing body at a hood edge and receives the cylinder head at least in the region of its cylinder head upper part.

14. A refrigerant compressor according to claim 13, wherein the hood and the sealing hood arranged thereunder receive the cylinder head upper part so as to completely cover it.

15. A refrigerant compressor according to claim 13, wherein the hood and the sealing hood arranged thereunder receive a valve plate arranged between the cylinder head lower part and the cylinder head upper part.

16. A refrigerant compressor according to claim 2, wherein the sealing element has a casing body extending from the contact body to the sealing body.

17. A refrigerant compressor according to claim 1, wherein the hood skirt widens with increasing extent from the hood cover in the direction of the cylinder head lower part.

18. A refrigerant compressor according to claim 1, wherein the hood covers the cylinder head upper part on the upper side face with the hood cover and covers an entire peripheral region of the cylinder head with the hood skirt, the hood skirt running from the hood cover in the direction of the cylinder head lower part and surrounding the cylinder head upper part.

19. A refrigerant compressor according to claim 1, wherein a connection attachment extends through the hood and forms a sealing surface for connection to a connection flange of a connection line.

20. A refrigerant compressor according to claim 19, wherein the connection attachment has a connection extension that rises above a foot region of the connection attachment, extends through the hood, and carries the sealing surface.

21. A refrigerant compressor according to claim 19, wherein the connection extension extends through an opening in the hood cover, and the hood cover of the hood externally surrounds the connection extension with the sealing surface.

22. A refrigerant compressor according to claim 1, wherein a seal arranged between a connection flange and a sealing surface also seals between the connection flange and an edge region of the hood cover.

23. A refrigerant compressor according to claim 1, wherein the cylinder head upper part is made of steel.

24. A refrigerant compressor according to claim 1, wherein the compressor is a two-stage compressor, and in that an outlet chamber for medium pressure and an outlet chamber for high pressure are provided in the cylinder head upper part.

25. A refrigerant compressor according to claim 1, wherein the refrigerant compressor is configured for $CO_2$ as refrigerant.

26. A refrigerant compressor, comprising an overall housing with a motor housing portion and a compressor housing portion, the compressor housing portion having a cylinder housing with a cylinder head, the cylinder head having a cylinder head lower part arranged on the cylinder housing, a cylinder head upper part which closes off the cylinder head, and at least one outlet chamber integrated in the cylinder head upper part, wherein the cylinder head is covered by means of a hood which engages over the cylinder head upper part on an upper side facing away from the cylinder head lower part with a hood cover and over the cylinder head in a region of a peripheral side of the cylinder head with a hood skirt surrounding the cylinder head, wherein a connection attachment extends through the hood and forms a sealing surface for connection to a connection flange of a connection line, wherein the connection attachment has a connection extension that rises above a foot region of the connection attachment, extends through the hood, and carries the sealing surface, and wherein the hood cover is supported on a step surface formed by the foot region of the connection attachment and extending laterally of the connection extension.

27. A refrigerant compressor according to claim 26, wherein the step surface runs around the connection extension.

28. A refrigerant compressor, comprising an overall housing with a motor housing portion and a compressor housing portion, the compressor housing portion having a cylinder housing with a cylinder head, the cylinder head having a cylinder head lower part arranged on the cylinder housing, a cylinder head upper part which closes off the cylinder head, and at least one outlet chamber integrated in the cylinder head upper part, wherein the cylinder head is covered by means of a hood which engages over the cylinder head upper part on an upper side facing away from the cylinder head lower part with a hood cover and over the cylinder head in a region of a peripheral side of the cylinder head with a hood skirt surrounding the cylinder head, wherein a connection attachment extends through the hood and forms a sealing surface for connection to a connection flange of a connection line, wherein the connection attachment has a connection extension that rises above a foot region of the connection attachment, extends through the hood, and carries the sealing surface, and wherein a contact body of a sealing element has an annular flange which abuts on a step surface, and wherein an edge region of the hood cover abuts on the annular flange and is supported thereby on the step surface.

29. A refrigerant compressor, comprising an overall housing with a motor housing portion and a compressor housing portion, the compressor housing portion having a cylinder housing with a cylinder head, the cylinder head having a cylinder head lower part arranged on the cylinder housing and a peripheral side extending between an upper side face and the cylinder housing, the cylinder head projecting above the cylinder housing to define the upper side face spaced from the cylinder housing and the peripheral side extending between the upper side face and the cylinder housing, a cylinder head upper part which closes off the cylinder head, and at least one outlet chamber integrated in the cylinder head upper part, wherein the cylinder head is covered by means of a hood which includes a hood cover and a hood skirt projecting from the hood cover, wherein the hood cover engages over the cylinder head upper part on the upper side face facing away from the cylinder head lower part and the hood skirt extends below the upper side face of the cylinder head and over and around the peripheral side of the cylinder head to surround the cylinder head lower part, and a sealing body is arranged for sealing between the hood skirt and the peripheral side of the cylinder head and in contact with the cylinder head.

30. A refrigerant compressor according to claim 29, wherein the sealing body peripherally seals around the cylinder head between the hood skirt and the peripheral side of the cylinder head.

31. A refrigerant compressor according to claim 29, wherein the sealing body is formed as a bead.

32. A refrigerant compressor according to claim 29, wherein the sealing body is made of an elastically deformable material, and the sealing body is elastically deformed between the hood skirt and the peripheral side of the cylinder head by being compressed between them.

33. A refrigerant compressor according to claim 29, wherein the sealing body is part of a sealing element which abuts on the upper side face of the cylinder head upper part with a contact body and extends from the contact body to the sealing body.

34. A refrigerant compressor, comprising an overall housing with a motor housing portion and a compressor housing portion, the compressor housing portion having a cylinder housing with a cylinder head, the cylinder head having a cylinder head lower part arranged on the cylinder housing, the cylinder head projecting above the cylinder housing to define an upper side face spaced from the cylinder housing and a peripheral side extending between the upper side face and the cylinder housing, a cylinder head upper part which closes off the cylinder head, and at least one outlet chamber integrated in the cylinder head upper part, wherein the cylinder head is covered by means of a hood which includes a hood cover and a hood skirt projecting from the hood cover, wherein the hood cover engages over the cylinder head upper part on the upper side face facing away from the cylinder head lower part and the hood skirt extends below the upper side face of the cylinder head and over and around the peripheral side of the cylinder head to surround the cylinder head, and wherein a valve plate is arranged between the cylinder head lower part and the cylinder head upper part, with the valve plate extending into the hood and being surrounded by the hood skirt, and wherein a part of the cylinder head has a face arranged facing an external environment.

35. A refrigerant compressor e-according to claim 34, wherein the part of the cylinder head comprises multiple portions of the cylinder head in spaced relation that project through the hood to have portion faces facing the external environment, the hood defining openings through which the multiple portions project into, respectively.

36. A refrigerant compressor according to claim 34, wherein a connection attachment extends through the hood and forms a sealing surface for connection to a connection flange of a connection line, the sealing surface providing said face arranged facing the external environment.

* * * * *